US005215877A

United States Patent [19]

Tomotake et al.

[11] Patent Number: 5,215,877

[45] Date of Patent: Jun. 1, 1993

[54] LIGHT-SENSITIVE SILVER HALIDE COLOR PHOTOGRAPHIC MATERIAL

[75] Inventors: Atsushi Tomotake; Noboru Mizukura, both of Hino, Japan

[73] Assignee: Konica Corporation, Tokyo, Japan

[21] Appl. No.: 748,237

[22] Filed: Aug. 21, 1991

[30] Foreign Application Priority Data

Sep. 14, 1990 [JP] Japan ..... 2-245949

[51] Int. Cl.[5] ..... G03C 7/36

[52] U.S. Cl. ..... 430/557; 430/389

[58] Field of Search ..... 430/557, 389

[56] References Cited

U.S. PATENT DOCUMENTS 4,404,274 9/1983 Arai et al. ..... 430/387

5,066,574 11/1991 Kubota et al. ..... 430/557

FOREIGN PATENT DOCUMENTS 255892 2/1988 European Pat. Off. .

0267491 5/1988 European Pat. Off. .

2936842 3/1980 Fed. Rep. of Germany .

3107173 2/1981 Fed. Rep. of Germany .

*Primary Examiner*—Lee C. Wright

*Attorney, Agent, or Firm*—Frishauf, Holtz, Goodman & Woodward

[57] ABSTRACT

Disclosed are a yellow coupler represented by the following formula (I) and a light-sensitive silver halide color photographic material having at least one silver halide emulsion layer on a support, which comprises a two-equivalent yellow coupler represented by the following formula (I) being contained in at least one of the above silver halide emulsion layers:

(I)

wherein $R_1$ represents an alkyl group or a cycloalkyl group; $R_2$ represents an alkyl group, a cycloalkyl group or an aryl group; $R_3$ represents a straight unsubstituted alkyl group having 8 to 20 carbon atoms; X represents $>NR_4$, —O— or $—S(O)_n—$; Y represents $>NR_5$ or where $R_4$ and $R_5$ each represent an alkyl group, a cycloalkyl group or an aryl group; and $R_6$ and $R_7$ each represent hydrogen atom, $—OR_8$, and $—S(O)_pR_8$ (where $R_8$ represents an alkyl group, a cycloalkyl group and an aryl group; $R_9$ represents hydrogen atom, an alkyl group, a cycloalkyl group or an aryl group; $R_8$ and $R_9$ may be bonded mutually to form a hetero ring; and p represents an integer of 0 to 2); $R_6$ and $R_7$ may be bonded mutually to form a ring; and n represents an integer of 0 to 2; $B_1$ represents a substitutable group on a benzene ring; and m represents an integer of 0 to 2.

12 Claims, No Drawings

LIGHT-SENSITIVE SILVER HALIDE COLOR PHOTOGRAPHIC MATERIAL

BACKGROUND OF THE INVENTION

This invention relates to a light-sensitive silver halide color photographic material, more particularly to a light-sensitive silver halide color photographic material using a novel two-equivalent yellow coupler which can be manufactured inexpensively and is excellent in activity, color reproducibility and image storage stability, high in solubility in low-boiling point and high-boiling solvents used for dispersing a coupler, and further excellent in dispersion stability.

In recent years, in light-sensitive silver halide color photographic materials (hereinafter sometimes called merely light-sensitive color materials), two-equivalent couplers in which an suitable substituent is introduced to a coupling position (active point) of a coupler which reacts with an oxidized product of a developing agent so that only 2 atoms of silver for forming one molecule of a dye are required have been employed frequently in place of conventional four-equivalent couplers which require 4 atoms of silver for forming one molecule of a dye. However, requirements of a coupler have become more strict with the progress of light-sensitive color materials. Not only improvement in activity but also further improvement in color reproducibility, image storage stability, solubility in low-boiling point and high-boiling point solvents and dispersion stability have been demanded.

As techniques for improving color reproducibility and activity, there has been known a yellow coupler having a heterocyclic compound with a cyclic imide structure as an eliminatable group and having an alkoxy group introduced to the 2-position of anilide portion For example, in Japanese Unexamined Patent Publication No. 115219/1977, there is disclosed a yellow coupler having an alkoxy group at the 2-position of anilide portion and having a hydantoin group or an urazol group as an eliminatable group. However, this coupler involves a drawback that light-resistance is extremely poor due to sulfamoyl group existing as a ballast group.

As techniques for improving light-resistance while maintaining good color reproducibility and high activity, there have been known, for example, yellow couplers having an alkoxy group at the 2-position and an acylamino group at the 5-position of anilide portion as disclosed in Japanese Unexamined Patent Publication No. 123047/1988. However, since these couplers have poor solubility in low-boiling point solvents such as ethyl acetate and high-boiling point solvents such as dibutyl phthalate, there involve such an inconvenience in manufacturing light-sensitive color materials that a large amount of a solvent should be used for dispersion, and further a drawback that these couplers are liable to be precipitated after dispersion in the above solvents. Under the present circumstances where thin film formation has been strongly demanded, it is apparent that these drawbacks are extremely emphasized and become a serious obstacle to practical use. Further, the coupler disclosed in said publication has a characteristic that a sulfonyl group is contained in a ballast group. For introducing this sulfonyl group, its manufacturing steps become complicated, and therefore there also involves a drawback that manufacture cost becomes expensive.

In Japanese Unexamined Patent Publications No. 6341/1975, No. 125140/1991 and No. 125141/1991, there are disclosed yellow couplers having an alkoxy group at the 2-position of anilide portion, a hydantoin group as an eliminatable group of which the 5-position is substituted by an alkyl group, and a straight unsubstituted alkylcarbonylamino group at the 5-position of anilide portion. In these couplers, since a ballast group is derived from an unsubstituted alkylcarboxylic acid, manufacture cost can be reduced, and further color reproducibility, light-resistance, solubilities in low-boiling point solvents and high-boiling point solvents such as dibutyl phthalate and dispersion stability are improved. However, since these couplers have activity slightly lowered due to an alkyl group existing at the 5-position of a hydantoin group which is an eliminatable group, they cannot satisfy the recent demand for heightening activity sufficiently.

In Japanese Unexamined Patent Publication No. 165145/1981, there is disclosed a yellow coupler having an alkoxy group at the 2-position of anilide portion, a urazol group as an eliminatable group and a substituted alkylcarbonylamino group at the 5-position. However, it has been found that this coupler is inferior in activity because the urazol group is unsubstituted and hydrophobicity of substituted components of the ballast group is too high.

SUMMARY OF THE INVENTION

The present invention has been made in consideration of the above problems A first object of the present invention is to provide a light-sensitive silver halide color photographic material containing a novel two-equivalent yellow coupler which can be manufactured inexpensively and is excellent in activity.

A second object of the present invention is to provide a light-sensitive silver halide color photographic material containing a novel two-equivalent yellow coupler which has high solubility in low-boiling point and high-boiling point solvents used for dispersing a coupler and exhibits excellent dispersion stability in the solvent A third object of the present invention is to provide a light-sensitive silver halide color photographic material containing a novel two-equivalent yellow coupler giving a sharp visible absorption spectrum necessary for excellent image storage stability (particularly excellent light-resistance) and also faithful color reproducibility by reacting with an oxidized product of a developing agent at the time of color development, and forming a dye giving a sharp color image.

The above objects of the present invention can be accomplished by a yellow coupler represented by the following formula (I) and a light-sensitive silver halide color photographic material having at least one silver halide emulsion layer on a support, which comprises a two-equivalent yellow coupler represented by the following formula (I) being contained in at least one of the above silver halide emulsion layers

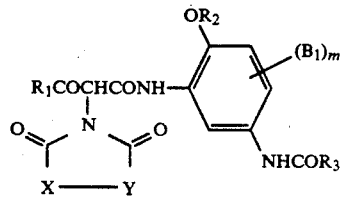

(I)

wherein $R_1$ represents an alkyl group or a cycloalkyl group; $R_2$ represents an alkyl group, a cycloalkyl group or an aryl group; $R_3$ represents a straight unsubstituted alkyl group having 8 to 20 carbon atoms; X represents $>NR_4$, —O— or $—S(O)_n—$; Y represents $>NR_5$ or

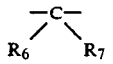

where $R_4$ and $R_5$ each represent an alkyl group, a cycloalkyl group or an aryl group; and $R_6$ and $R_7$ each represent hydrogen atom, —$OR_8$,

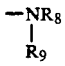

and $—S(O)_pR_8$ (where $R_8$ represents an alkyl group, a cycloalkyl group and an aryl group; $R_9$ represents hydrogen atom, an alkyl group, a cycloalkyl group or an aryl group; $R_8$ and $R_9$ may be bonded mutually to form a hetero ring; and p represents an integer of 0 to 2); $R_6$ and $R_7$ may be bonded mutually to form a ring; and n represents an integer of 0 to 2; $B_1$ represents a substitutable group on a benzene ring; and m represents an integer of 0 to 2.

DESCRIPTION OF THE PREFERRED EMBODIMENTS

In the following, the present invention is explained in detail.

In the above formula (I), the alkyl group represented by $R_1$ or $R_2$ may include a straight or branched alkyl group preferably having 1 to 6 carbon atoms, more preferably 1 to 4 carbon atoms, for example, methyl group, ethyl group, isopropyl group, t-butyl group and dodecyl group, and the cycloalkyl group may preferably have 3 to 8 carbon atoms, more preferably 5 to 7 carbon atoms, and may include cyclopropyl group, cyclohexyl group and adamantyl group. The aryl group represented by $R_2$ may include a phenyl group. These alkyl, cycloalkyl and aryl groups may further have a substituent(s). As the substituent, there may be mentioned, for example, a halogen atom (e.g. chlorine atom and bromine atom), an aryl group (e.g. phenyl group and p-t-octylphenyl group), an alkoxy group (e.g. methoxy group), an aryloxy group (e.g. 2,4-di-t-amylphenoxy group), an alkylsulfonyl group (e.g. methanesulfonyl group), an acylamino group (e.g. acetylamino group and benzoylamino group) and hydroxy group.

$R_1$ is preferably an alkyl group, more preferably a branched alkyl group, particularly preferably t-butyl group.

$R_2$ is preferably an alkyl group, particularly preferably methyl group.

In the above formula (I), $R_3$ represents a straight unsubstituted alkyl group having 8 to 20 carbon atoms, and may include, for example, n-nonyl group, n-undecyl group, n-tridecyl group, n-pentadecyl group and n-heptadecyl group.

In the above formula (I), as the alkyl and cycloalkyl groups represented by $R_4$ and $R_5$, there may be included the same groups as mentioned in the above $R_1$ and $R_2$.

The aryl groups represented by $R_4$ and $R_5$ may include a phenyl group or a naphthyl group. These aryl groups represented by $R_4$ and $R_5$ can further have substituents. As the substituent, there may be mentioned, for example, a halogen atom (e.g. chlorine atom and bromine atom), an alkyl group (e.g. methyl group and i-propyl group), a cycloalkyl group (e.g. cyclohexyl group), an aryl group (e.g. phenyl group and p-t-octylphenyl group), an alkoxy group (e.g. methoxy group), an aryoxy group (e.g. 2,4-di-t-amylphenoxy group), an alkylsulfonyl group (e.g. methanesulfonyl group), an acylamino group (e.g. acetylamino group and benzoylamino group) and hydroxy group.

X is preferably $>NR_4$.

$R_4$ is preferably an alkyl group or a cycloalkyl group, more preferably an alkyl group.

$R_5$ is preferably an alkyl group or an aryl group, more preferably an aryl group.

In the above formula (I), $R_6$ and $R_7$ each represent hydrogen atom, —$OR_8$,

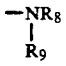

and $—S(O)_pR_8$. These $R_6$ and $R_7$ may be the same or different, or may be mutually bonded to form a ring such as a 1,3-dioxine ring and a 1,3-oxazolidine ring. $R_6$ and $R_7$ are preferably hydrogen atom or —$OR_8$, more preferably hydrogen atoms.

However, $R_4$ and $R_5$, or $R_4$ and $R_6$ or $R_7$ are not mutually bonded to form a ring.

In the above formula (I), as the alkyl and cycloalkyl groups represented by $R_8$ and $R_9$, there may be included the same groups as mentioned in the above $R_1$ and $R_2$.

As the aryl group represented by $R_8$ and $R_9$, there may be included the same aryl groups as mentioned in the description of the above $R_1$ and $R_2$. $R_8$ and $R_9$ may be bonded mutually to form a hetero ring such as a piperidine ring, a pyrazole ring, a morpholine ring or a pyridine ring.

$R_8$ is preferably an alkyl group, and $R_9$ is preferably hydrogen atom or an alkyl group.

In the above formula (I), as the substitutable group on a benzene ring represented by $B_1$, there may be mentioned the same alkyl and cycloalkyl groups as those represented by the above $R_1$ and $R_2$, and also the same substituent(s) for the aryl groups as mentioned in the description of the above $R_4$, and further there may be mentioned a halogen atom (e.g. chlorine atom and bromine atom), hydroxy group, an alkoxy group (e.g. methoxy group), an aryloxy group (e.g. 2,4-di-t-amylphenoxy group), an acyloxy group (e.g. methylcarbonyloxy group and benzoyloxy group), an alkylsulfonyl group (e.g. methanesulfonyl group), an arylsulfonyl group (e.g. benzenesulfonyl group and p-toluenesulfonyl group), a sulfamoyl group (e.g. N-propylsulfamoyl group and N-phenylsulfamoyl group), an acylamino group (e.g. acetylamino group, benzoylamino group and 3-(2,4-di-t-amylphenoxy)butyroyl group), an alkylsulfonylamino group (e.g. methanesulfonylamino group and dodecanesulfonylamino group), an arylsulfonylamino group (e.g. benzenesulfonylamino group), a carbamoyl group (e.g. N-methylcarbamoyl group and N-phenylcarbamoyl group), an alkoxycarbonyl group (e.g. methoxycarbonyl group and dodecyloxycarbonyl group), an aryloxycarbonyl group (e.g. phenoxycarbonyl group) and an imide group (e.g. succinimide group). m represents an integer of 0 to 2.

The two-equivalent yellow coupler represented by the above formula (I) may be bonded to either one of the substituents to form a bis product (dimeric product). In the following, representative specific examples of the two-equivalent yellow coupler represented by the formula (I) to be used in the present invention are shown, but the present invention is not limited thereto.
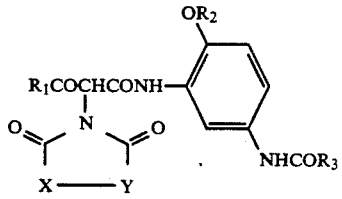
| No. | $R_1$ | $R_2$ | $R_3$ | 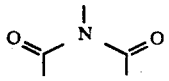 |
|---|---|---|---|---|
| (1) | t-$C_4H_9$ | $CH_3$ | $C_{13}H_{27}$ | 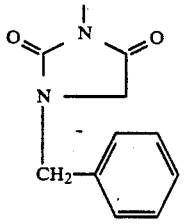 |
| (2) | " | " | " | 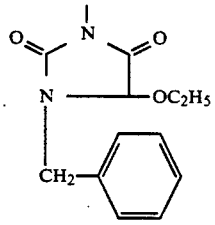 |
| (3) | " | " | " | 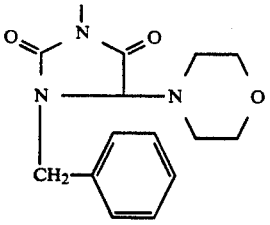 |
| (4) | " | " | " | 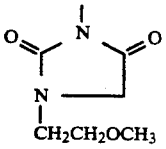 |
| (5) | t-$C_4H_9$ | $CH_3$ | $C_{15}H_{31}$ | 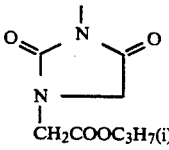 |

-continued
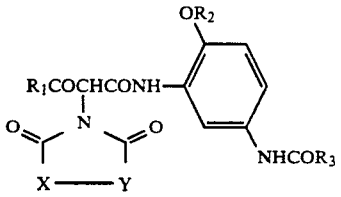
| No. | $R_1$ | $R_2$ | $R_3$ | 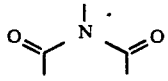 |
|---|---|---|---|---|
| (6) | " | " | " | 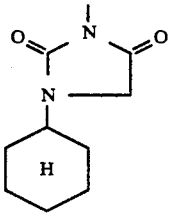 |
| (7) | " | " | $C_{11}H_{23}$ | 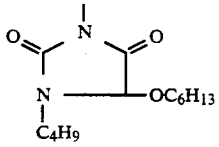 |
| (8) | " | " | " | 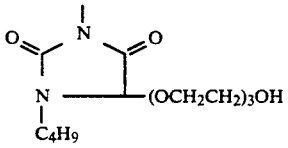 |
| (9) | " | " | $C_9H_{19}$ | 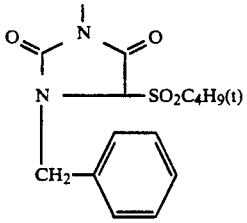 |
| (10) | t-$C_4H_9$ | $CH_3$ | $C_{13}H_{27}$ | 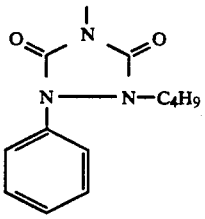 |
| (11) | " | " | " | 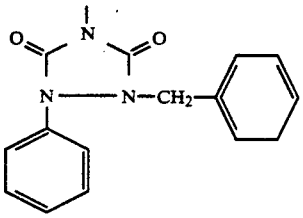 |

-continued
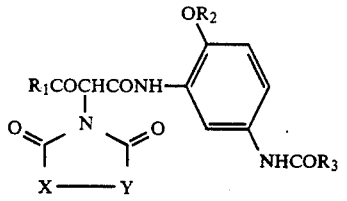
| No. | $R_1$ | $R_2$ | $R_3$ | 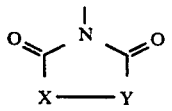 |
|---|---|---|---|---|
| (12) | " | " | " | 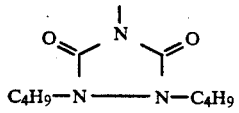 |
| (13) | " | " | $C_{15}H_{31}$ | 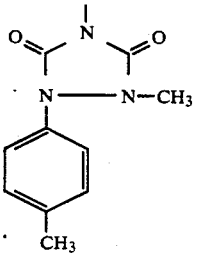 |
| (14) | " | " | " | 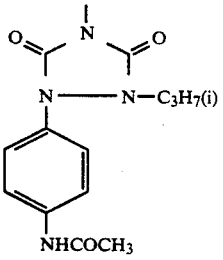 |
| (15) | t-$C_4H_9$ | $CH_3$ | $C_{11}H_{23}$ | 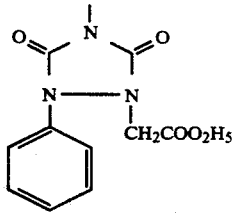 |
| (16) | " | " | " | 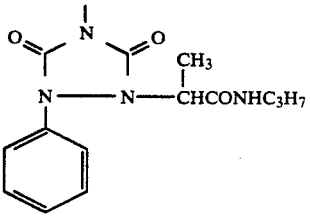 |

-continued
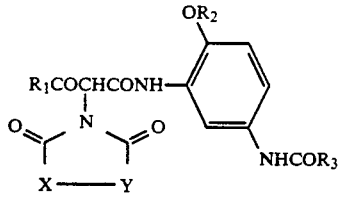
| No. | $R_1$ | $R_2$ | $R_3$ | 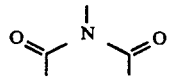 |
|---|---|---|---|---|
| (17) | " | " | $C_9H_{19}$ | 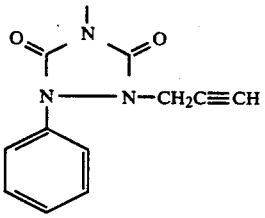 |
| (18) | " | " | $C_{17}H_{35}$ | 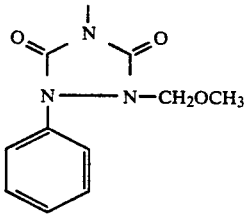 |
| (19) | " | " | $C_{13}H_{27}$ | 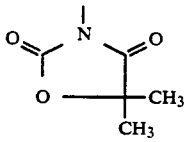 |
| (20) | t-$C_4H_9$ | $CH_3$ | $C_{13}H_{27}$ | 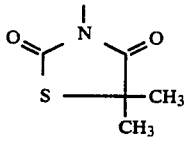 |
| (21) | " | " | $C_{15}H_{31}$ | 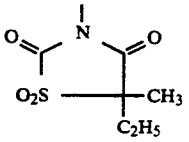 |
| (22) | " | " | $C_{11}H_{23}$ | 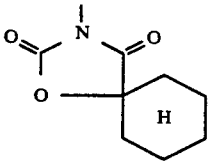 |

-continued

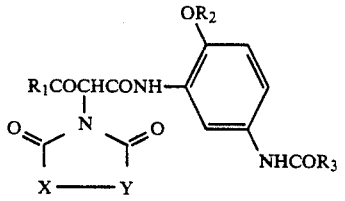

| No. | $R_1$ | $R_2$ | $R_3$ | 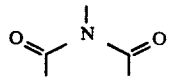 |
|---|---|---|---|---|
| (23) | " | $C_3H_7$(i) | " | 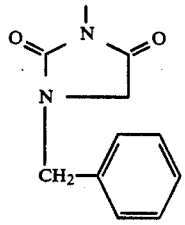 |
| (24) | " | 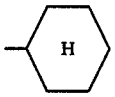 | $C_{13}H_{27}$ | 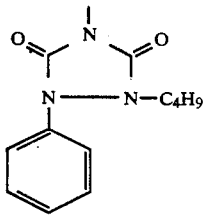 |
| (25) | t-$C_4H_9$ | 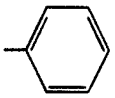 | $C_{13}H_{27}$ | 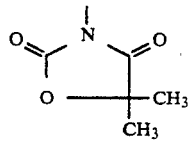 |
| (26) | 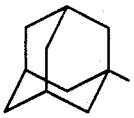 | $CH_3$ | $C_{11}H_{23}$ | 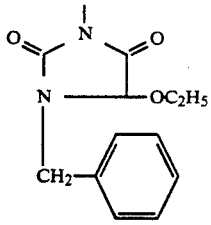 |

The yellow coupler represented by the formula (I) of the present invention can be synthesized easily according to a conventionally known method.

In the following, the representative synthesis example of the present invention is shown.

SYNTHESIS EXAMPLE

Synthesis of Exemplary coupler (1)

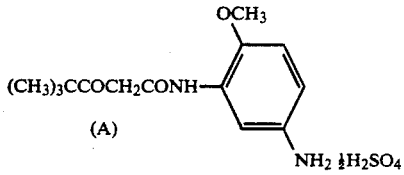

(A)

+

-continued $ClCOC_{13}H_{27}$ →

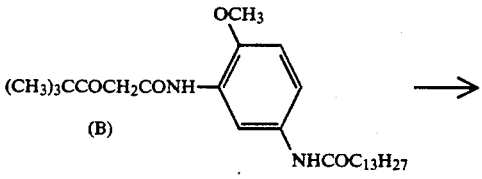

(B)

→

-continued

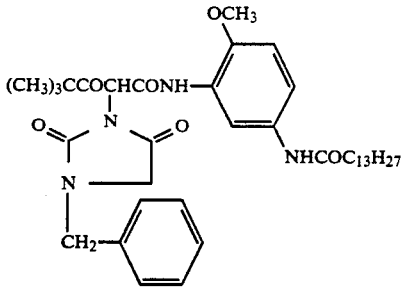

(1) Synthesis of four-equivalent coupler (B)

In 200 ml of ethyl acetate was suspended 31.3 g of α-pivaloyl-2-methoxy-5-aminoacetanilide sulfate (A), and 100 ml of water and 10.6 g of sodium carbonate were added thereto, followed by vigorous stirring. A solution of 25.9 g of myristic acid chloride dissolved in 50 ml of ethyl acetate was added to the mixture dropwise. After completion of the dropwise addition, the mixture was stirred at room temperature for 1 hour, and the organic layer was washed with a 5% potassium carbonate aqueous solution and with diluted hydrochloric acid. After dehydration with magnesium sulfate, the solvent was removed under reduced pressure, and then the residue was recrystallized from 400 ml of methanol to obtain the desired four-equivalent coupler (B). Yield: 38.1 g (80%).

(2) Synthesis of Exemplary coupler (1)

In 100 ml of chloroform was dissolved 9.5 g of the four-equivalent coupler (B) obtained as described above, and 2.8 g of sulfuryl chloride was added dropwise under ice cooling. After the dropwise addition, the mixture was stirred for 1 hour under the same conditions. The reaction mixture was washed and dehydrated with magnesium sulfate, followed by removal of the solvent under reduced pressure. The resulting residue was dissolved in 100 ml of acetone, and 4.0 g of 3-benzylhydantoin and 2.9 g of potassium carbonate were added thereto. Then, the mixture was refluxed by heating for 3 hours. The insolubles were removed by filtration, and then the filtrate was washed with a 5% potassium carbonate aqueous solution and with diluted hydrochloric acid. After dehydration with magnesium sulfate, the solvent was removed under reduced pressure, and the residue was recrystallized from 50 ml of methanol to obtain the desired Exemplary coupler (1). Yield: 7.6 g (57%).

The structure of Exemplary coupler (1) was confirmed by NMR, IR and mass spectra.

Exemplary couplers other than Exemplary coupler (1) were synthesized from the corresponding starting materials, respectively, according to the method as in the above synthesis examples.

The yellow coupler of the present invention can be used singly or in combination of two or more of them. Further, all known pivaloyl acetanilide type or benzoyl acetanilide type yellow couplers can be used in combination.

The yellow coupler of the present invention may be incorporated into a silver halide photographic emulsion of a light-sensitive color photographic material by, for example, dissolving the yellow coupler in at least one high-boiling point organic solvent having a boiling point of 175° C. or higher such as tricresyl phosphate or dibutyl phthalate and/or at least one low-boiling point organic solvent such as ethyl acetate, methanol, acetone, chloroform, methyl chloride or butyl propionate used at the time of preparing a coupler dispersion in the prior art, mixing the resulting solution with an aqueous gelatin solution containing a surfactant, subsequently emulsifying and dispersing the mixture by using a high-speed rotary mixer or a colloid mill, and then adding the resulting emulsified dispersion directly to the silver halide photographic emulsion, or setting and then shredding the above emulsified dispersion, removing the low-boiling point organic solvent by using a means such as washing, and then adding the resulting product to the silver halide photographic emulsion.

The yellow coupler of the present invention is generally added preferably in an amount of about $1\times10^{-3}$ mole to about 1 mole per mole of silver halide, but the amount to be added may be changed to the amount exceeding the above range depending on the purpose of its application.

The light-sensitive silver halide color photographic material of the present invention may be any light-sensitive material used for any purpose, and as the silver halide, there may be used, for example, silver chloride, silver bromide, silver iodide, silver chlorobromide, silver iodobromide and silver chloroiodobromide.

In the light-sensitive silver halide color photographic material of the present invention, other color couplers for forming a multicolor image can be contained together with the yellow coupler according to the present invention.

In the light-sensitive silver halide color photographic material of the present invention, there can be used a color antifoggant, an image stabilizer, a hardener, a plasticizer, a polymer latex, a formalin scavenger, a mordant, a development accelerator, a development retardant, a fluorescent brightener, a matting agent, a solvent, an antistatic agent and a surfactant as desired. By incorporating a UV absorber into the light-sensitive silver halide color photographic material containing the yellow coupler of the present invention, fade resistance of an yellow image formed on the light-sensitive material can be further improved.

EXAMPLES

The present invention is described in detail by referring to Examples, but the embodiment of the present invention is not limited to these Examples.

EXAMPLE 1

The yellow couplers of the present invention shown in Table 1 (the coupler number corresponds to the exemplary coupler number shown above) and the comparative couplers represented by Y-1 to Y-3 shown below were added in an amount of $3.0\times10^{-2}$ mole, respectively, to the mixtures comprising dibutyl phthalate in an amount corresponding to a quarter of the weight of the respective yellow couplers, Phenol compound P-1 shown below in an amount corresponding to a quarter of the weight of the respective yellow couplers and 40 ml of ethyl acetate, and the mixtures were heated to 50° C. to dissolve the respective couplers therein.

The respective solutions thus prepared were mixed with 10 ml of a 10% aqueous solution of Alkanol B (alkylnaphthalenesulfonate, trade name, manufactured by Du Pont Co.) and 200 ml of a 5% gelatin aqueous solution, respectively, and then the mixtures were emulsified by passing them through a colloid mill several times to prepare 12 kinds of Dispersions (A) containing the above couplers, respectively. The turbidity of Dispersions (A) was measured by using a Poic integrating sphere type turbidity meter (manufactured by Nippon Seimitsu Kogaku K.K.).

The respective half amounts of the above Dispersions (A) were maintained at 40° C. for 8 hours to obtain Dispersions (B), respectively, and the turbidities of Dispersions (B) were also measured in the same manner. These results are shown in Table 1.

Next, these Dispersions (A) and (B) were added to 500 ml of a gelatin silver chlorobromide emulsion, and the mixtures were so coated on a polyethylene-laminated paper that the coated amount of silver chlorobromide became 0.25 g/m$^2$, and then dried to prepare Present samples 1 to 10 and Comparative samples 1 to 3 comprising the light-sensitive silver halide color photographic material.

Subsequently, the respective samples thus obtained were subjected to wedge exposure according to a conventional method, and then the exposed samples were processed according to the following development processing steps and recipes of processing solutions.

Development processing steps

| | Processing temperature | Processing time |
|---|---|---|
| Color development | 38° C. | 3 min 30 sec |
| Bleach-fixing | 33° C. | 1 min 30 sec |
| Washing | 33° C. | 3 min |
| Drying | 50 to 80° C. | 2 min |

Composition of color developing solution

| | |
|---|---|
| Benzyl alcohol | 12 ml |
| Diethylene glycol | 10 ml |
| Potassium carbonate | 25 g |
| Sodium bromide | 0.6 g |
| Anhydrous sodium sulfite | 2.0 g |
| Hydroxylamine sulfate | 2.5 g |
| N-ethyl-N-β-methanesulfonamidoethyl-3-methyl-4-aminoaniline sulfate | 4.5 g |
| made up to 1 liter with addition of water, and adjusted pH to 10.2 with sodium hydroxide. | |

Composition of bleach-fixing solution

| | |
|---|---|
| Ammonium thiosulfate | 120 g |
| Sodium metabisulfite | 15 g |
| Anhydrous sodium sulfite | 3 g |
| Ferric ammonium·ethylenediaminetetra-acetate | 65 g |
| made up to 1 liter with addition of water, and adjusted pH to 6.7 to 6.8. | |

The maximum color density of the dye images formed on the respective samples by the above processings was measured, and also the sensitivity of these samples was measured. The results are shown in Table 1.

Comparative coupler Y-1

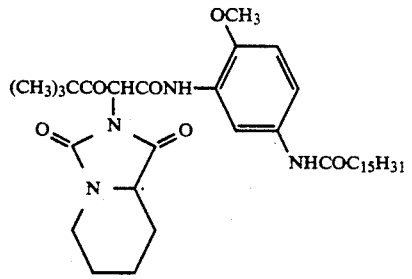

(Coupler disclosed in Japanese Unexamined Patent Publication No. 6341/1975)

Comparative coupler Y-2

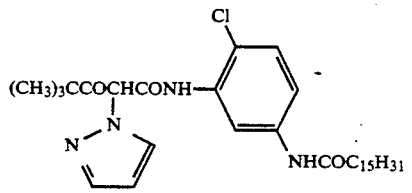

(Coupler disclosed in Japanese Unexamined Patent Publication No. 161239/1980)

Comparative coupler Y-3

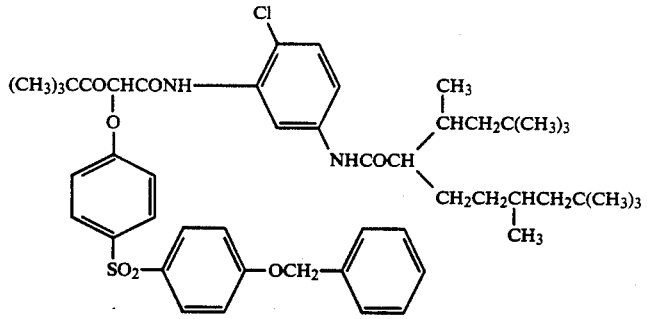

(Coupler disclosed in Japanese Unexamined Patent Publication No. 38576/1980)

Phenol compound P-1

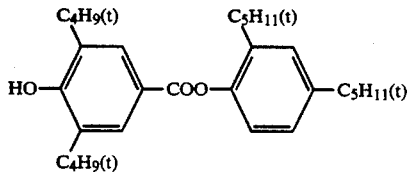

TABLE 1

| Sample No. | Kind of coupler | Turbidity (ppm) Dispersion (A) | Turbidity (ppm) Dispersion (B) | Sample using Dispersion (A) Sensitivity* | Sample using Dispersion (A) Maximum density | Sample using Dispersion (B) Sensitivity* | Sample using Dispersion (B) Maximum density |
|---|---|---|---|---|---|---|---|
| Present sample 1 | Present coupler 1 | 21 | 33 | 132 | 2.60 | 120 | 2.38 |
| Present sample 2 | Present coupler 2 | 23 | 34 | 128 | 2.48 | 116 | 2.30 |
| Present sample 3 | Present coupler 4 | 24 | 34 | 125 | 2.56 | 118 | 2.32 |
| Present sample 4 | Present coupler 5 | 22 | 35 | 126 | 2.52 | 116 | 2.30 |
| Present sample 5 | Present coupler 8 | 25 | 38 | 122 | 2.54 | 110 | 2.26 |
| Present sample 6 | Present coupler 10 | 22 | 30 | 133 | 2.58 | 122 | 2.40 |
| Present sample 7 | Present coupler 12 | 25 | 34 | 124 | 2.48 | 119 | 2.33 |
| Present sample 8 | Present coupler 15 | 28 | 36 | 120 | 2.49 | 111 | 2.31 |
| Present sample 9 | Present coupler 19 | 28 | 44 | 117 | 2.46 | 109 | 2.25 |
| Present sample 10 | Present coupler 20 | 26 | 40 | 116 | 2.47 | 112 | 2.25 |
| Comparative sample 1 | Comparative coupler Y-1 | 40 | 62 | 100 | 2.26 | 72 | 2.02 |
| Comparative sample 2 | Comparative coupler Y-2 | 52 | 77 | 103 | 2.33 | 65 | 1.95 |
| Comparative sample 3 | Comparative coupler Y-3 | 30 | 52 | 110 | 2.37 | 87 | 2.05 |

*Sensitivity is represented in a relative sensitivity when the sensitivity of Comparative sample 1 using Dispersion (A) is defined as 100.

From the results shown in Table 1, it can be understood that even when either of Dispersion (A) and Dispersion (B) was used, in the present samples, the maximum color density higher then that of the comparative samples was obtained, lowering in sensitivity and the maximum color density observed between the samples using Dispersions (A) and (B), respectively, is smaller than that of the comparative examples, and therefore the couplers of the present invention exhibit excellent dispersion stability not only in the coupler dispersion immediately after preparation but also in the stored coupler dispersion.

EXAMPLE 2

(Preparation of silver halide emulsion)

According to the neutral method and double jet method, 3 kinds of silver halide emulsions shown in Table 2 were prepared.

TABLE 2

| Emulsion No. | AgCl (%) | AgBr (%) | Average particle size (μ) | Chemical sensitizer | Spectral sensitizing dye |
|---|---|---|---|---|---|
| Em-1 | 99.5 | 0.5 | 0.67 | Sodium thiosulfate*1 | SD-1*3 |
| Em-2 | 99.5 | 0.5 | 0.46 | Chloroauric acid*2 | SD-2*4 |
| Em-3 | 99.5 | 0.5 | 0.43 | | SD-3*5 |

*1added in an amount of 2 mg per mole of silver halide
*2added in an amount of $5 \times 10^{-5}$ mole per mole of silver halide
*3added in an amount of 0.9 mmole per mole of silver halide
*4added in an amount of 0.7 mmole per mole of silver halide
*5added in an amount of 0.2 mmole per mole of silver halide After completion of chemical sensitization, STB-1 shown below was added in an amount of $5 \times 10^{-3}$ mole per mole of silver halide as an emulsion stabilizer to the respective silver halide emulsions.

SD-1

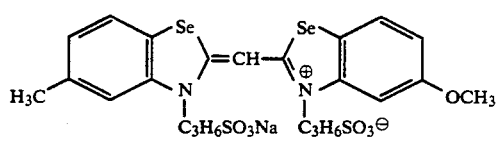

SD-2

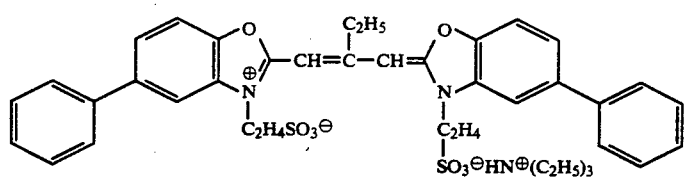

SD-3

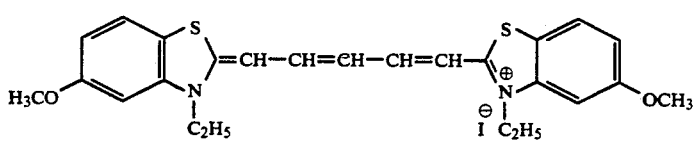

STB-1

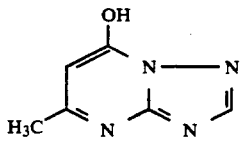

(Preparation of light-sensitive silver halide color photographic material)

Subsequently, the following Layers 1 to 7 were provided by coating (simultaneous coating) successively on a paper support of which both surfaces had been coated with polyethylene to prepare Present samples 11 to 16 and Comparative samples 4 to 6 comprising the light-sensitive silver halide color photographic material. (In the following Examples, amounts added are represented in an amount per 1 $m^2$ of the light-sensitive material.)

Layer 1 . . . A layer containing 1.2 g of gelatin, 0.29 g (calculated on silver, hereinafter the same) of a blue-sensitive silver halide emulsion (Em-1), and 1.0 mmole of a yellow coupler shown in Table 3, 0.3 g of a light stabilizer (ST-1) and 0.015 g of 2,5-dioctyl hydroquinone (HQ-1) dissolved in 0.3 g of dinonyl phthalate (DNP).

Layer 2 . . . A layer containing 0.9 g of gelatin and 0.04 g of HQ-1 dissolved in 0.2 g of dioctyl phthalate (DOP).

Layer 3 . . . A layer containing 1.4 g of gelatin, 0.2 g of a green-sensitive silver halide emulsion (Em-2), and 0.9 mmole of a magenta coupler (M-1), 0.25 g of a light stabilizer (ST-3), 0.35 g of a light stabilizer (ST-2) and 0.01 g of HQ-1 dissolved in 0.3 g of DOP, and 6 mg of a filter dye (AI-1) shown below.

Layer 4 . . . A layer containing 1.2 g of gelatin, and 0.6 g of an UV absorber (UV-1) and 0.05 g of HQ-1 dissolved in 0.3 g DNP.

Layer 5 . . . A layer containing 1.4 g of gelatin, 0.20 g of a red-sensitive silver halide emulsion (Em-3), and 1.0 mmole of a cyan coupler (C-1), 0.01 g of HQ-1 and 0.3 g of ST-1 dissolved in 0/3 g of DOP.

Layer 6 . . . A layer containing 1.1 g of gelatin, 0.2 g of UV-1 dissolved in 0.2 g of DOP, and 5 mg of a filter dye (AI-2) shown below.

Layer 7 . . . A layer containing 1.0 g of gelatin and 0.05 g of 2,4-dichloro-6-hydroxytriazine sodium.

M-1

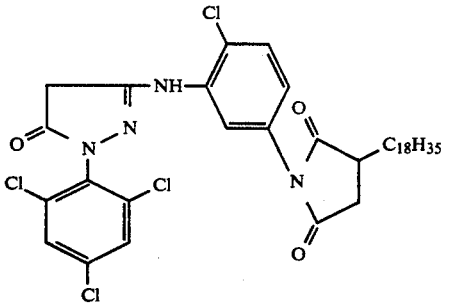

ST-1

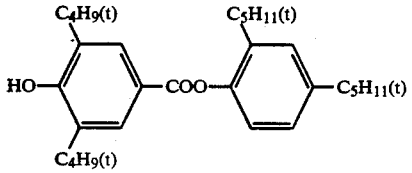

ST-2

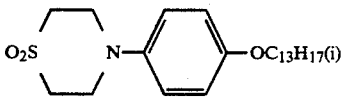

-continued

ST-3

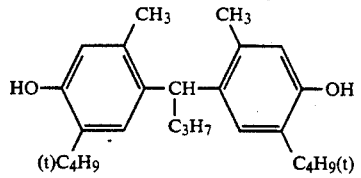

UV-1

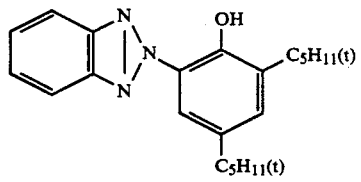

AI-1

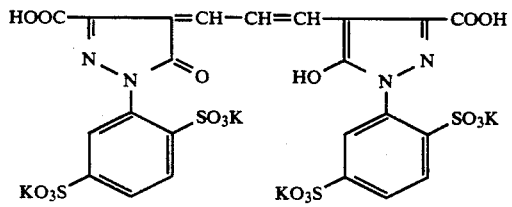

AI-2

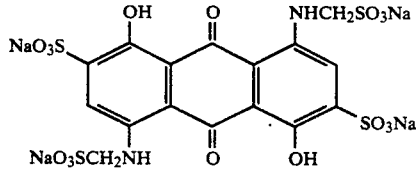

C-1

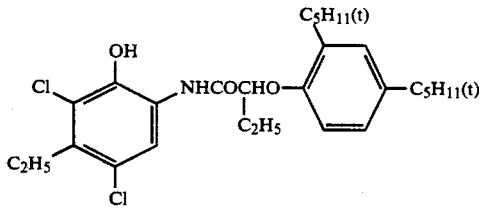

The samples thus obtained were subjected to wedge exposure with monochromatic blue, green and red lights by using a sensitometer Model KS-7 (trade name, manufactured by Konica Corporation), and then processed according to color development processing steps shown below. Thereafter, the reflectance density of the blue-sensitive emulsion layer was measured by using an optical densitometer Model PDA-65 (trade name, manufactured by Konica Corporation).

After the color tone of the gray portion of the negative film obtained by photographing a color checker (manufactured by Macbeth Co.) by using Konica Color GX-II100 (trade name, manufactured by Konica Corporation) and developing the film was modified, it was printed on the samples obtained above, and the color reproducibility of yellow was evaluated.

The results are shown in Table 3.

| Processing steps | Temperature | Time |
|---|---|---|
| Color development | 34.7 ± 0.3° C. | 45 sec |
| Bleach-fixing | 34.7 ± 0.5° C. | 50 sec |
| Stabilizing | 30 to 34° C. | 90 sec |
| Drying | 60 to 80° C. | 60 sec |
| Color developing solution | | |
| Pure water | | 800 ml |
| Triethanolamine | | 8 g |

-continued

| | |
|---|---|
| N,N-diethylhydroxylamine | 5 g |
| Potassium chloride | 2 g |
| N-ethyl-N-β-methanesulfonamidoethyl-3-methyl-4-aminoaniline sulfate | 5 g |
| Sodium tetrapolyphosphate | 2 g |
| Potassium carbonate | 30 g |
| Potassium sulfite | 0.2 g |
| Fluorescent brightener (4,4'-diaminostilbendisulfonic acid derivative) | 1 g |
| made up to 1 liter in total with addition of pure water, and adjusted pH to 10.2. | |
| Bleach-fixing solution | |
| Ferric ammonium ethylenediaminetetraacetate dihydrate | 60 g |
| Ethylenediaminetetraacetate | 3 g |
| Ammonium thiosulfate (70% solution) | 100 ml |
| Ammonium sulfite (40% solution) | 27.5 ml |
| adjusted pH to 5.7 with potassium carbonate or glacial acetic acid, and made up to 1 liter in total with addition of water. | |
| Stabilizing solution | |
| 5-Chloro-2-methyl-4-isothiazolin-3-one | 1 g |
| 1-Hydroxyethylidene-1,1-diphosphonic acid | 2 g |
| made up to 1 liter with addition of water, and adjusted pH to 7.0 with sulfuric acid or potassium hydroxide. | |

TABLE 3

| Sample No. | Kind of coupler | Color reproducibility*3 | Sensitivity*1 | Fog*2 | Maximum density |
|---|---|---|---|---|---|
| Present sample 11 | Present coupler 1 | ○ | 132 | −0.02 | 2.33 |
| Present sample 12 | Present coupler 3 | ○ | 123 | −0.03 | 2.22 |
| Present sample 13 | Present coupler 5 | ○ | 126 | −0.03 | 2.24 |
| Present sample 14 | Present coupler 10 | ○ | 131 | −0.02 | 2.36 |
| Present sample 15 | Present coupler 12 | ○ | 127 | −0.02 | 2.27 |
| Present sample 16 | Present coupler 20 | ○ | 118 | −0.01 | 2.20 |
| Comparative sample 4 | Comparative coupler Y-1 | ○ | 100 | ±0 | 1.90 |
| Comparative sample 5 | Comparative coupler Y-2 | X | 102 | +0.02 | 1.89 |
| Comparative sample 6 | Comparative coupler Y-3 | X | 106 | +0.04 | 2.04 |

*1Sensitivity is represented in a relative value when the sensitivity of Comparative sample 4 is defined as 100.
*2Fog is represented in difference from the fog value of Comparative sample 4.
*3○ means good color reproducibility (tone and chromaticness)
X means poor color reproducibility (tone and chromaticness)

From the results shown in Table 3, it can be understood that while the color reproducibility of yellow is poor in Comparative samples 5 and 6 using Comparative Yellow Couplers Y-2 and Y-3 in which the 2-position of the anilide portion is substituted by chlorine atom, the color reproducibility is satisfactory in all the present samples using the couplers of the present invention in which the 2-position of the anilide portion is substituted by methoxy group. Since all the present samples using the couplers of the present invention exhibit higher maximum color density, form dye images less in fog, and also exhibit higher sensitivity when compared with the comparative samples, it can be understood that the couplers of the present invention have high activity.

As described above, the present invention can provide a light-sensitive silver halide color photographic material containing a two-equivalent yellow coupler excellent in activity, high in solubility in low-boiling point solvents, exhibiting excellent dispersion stability in the solvents, and also excellent in color reproducibility.

I claim:

1. A light-sensitive silver halide color photographic material having at least one silver halide emulsion layer on a support, which comprises a two-equivalent yellow coupler represented by the following formula (I) being contained in at least one of the above silver halide emulsion layers:

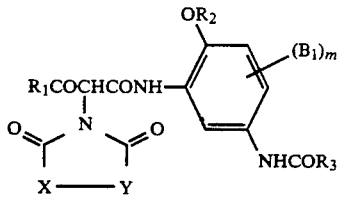

(I)

wherein $R_1$ represents an alkyl group or a cycloalkyl group; $R_2$ represents an alkyl group, a cycloalkyl group or an aryl group; $R_3$ represents a straight unsubstituted alkyl group having 8 to 20 carbon atoms; X represents $>NR_4$, —O— or $—S(O)_n—$; Y represents $>NR_5$ or

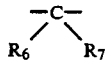

where $R_4$ and $R_5$ each represent an alkyl group, a cycloalkyl group or an aryl group; and $R_6$ and $R_7$ each represent hydrogen atom, $—OR_8$,

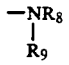

and $—S(O)_pR_8$ (where $R_8$ represents an alkyl group, a cycloalkyl group and an aryl group; $R_9$ represents hydrogen atom, an alkyl group, a cycloalkyl group or an aryl group; $R_8$ and $R_9$ may be bonded mutually to form a hetero ring; and p represents an integer of 0 to 2); $R_6$ and $R_7$ may be bonded mutually to form a ring; and n represents an integer of 0 to 2; $B_1$ represents a substitutable group on a benzene ring; and m represents an integer of 0 to 2.

2. The material of claim 1 wherein $R_1$ is a straight or branched alkyl group selected from the group consisting of methyl group, ethyl group, isopropyl group, t-butyl group and dodecyl group, or adamantyl group.

3. The material of claim 1 wherein $R_2$ is a straight or branched alkyl group selected from the group consisting of methyl group, ethyl group, isopropyl group, t-butyl group and dodecyl group, a cyclohexyl group or a phenyl group.

4. The material of claim 1 wherein $R_3$ is n-nonyl group, n-undecyl group, n-tridecyl group, n-pentadecyl group or n-heptadecyl group.

5. The material of claim 1 wherein X represents $>NR_4$, —O— or —S—.

6. The material of claim 5 wherein $R_1$ is a branched alkyl group.

7. The material of claim 4 wherein $R_2$ is a substituted or unsubstituted alkyl group or aryl group.

8. The material of claim 1 wherein X is $>NR_4$, and Y is $>NR_5$ or

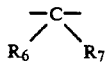

where $R_4$ is a substituted or unsubstituted alkyl group or cycloalkyl group, $R_5$ is a substituted or unsubstituted alkyl group or aryl group, and $R_6$ and $R_7$ are each hydrogen atom, or a substituted or unsubstituted alkoxy group.

9. The material of claim 1 wherein X is $>NR_4$, and Y is $>NR_5$ where $R_4$ is a substituted or unsubstituted alkyl group, and $R_5$ is a substituted or unsubstituted aryl group.

10. The material of claim 1 wherein X is $>NR_4$, and Y is

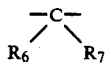

where $R_4$ is a substituted or unsubstituted alkyl group, and $R_6$ and $R_7$ are each hydrogen atom, or a substituted or unsubstituted alkoxy group.

11. The material of claim 1 wherein $R_1$ is t-butyl group, $R_2$ is methyl group, $R_3$ is a straight alkyl group having 11 to 17 carbon atoms, X is $>NCH_2C_6H_5$, and Y is $-CH_2-$.

12. The material of claim 1 wherein said coupler is at least one selected from the group consisting of:

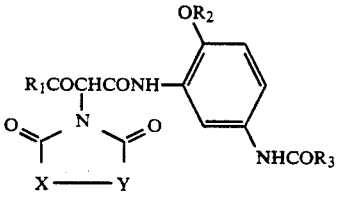

| No. | $R_1$ | $R_2$ | $R_3$ | X——Y |
|---|---|---|---|---|
| (1) | t-$C_4H_9$ | $CH_3$ | $C_{13}H_{27}$ | 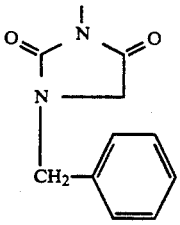 |
| (2) | " | " | " | 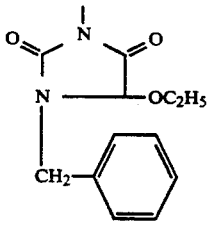 |
| (3) | " | " | " | 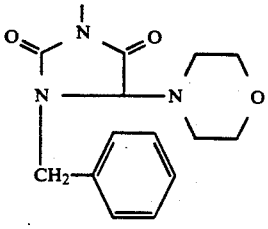 |

-continued
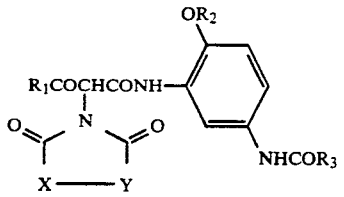
| No. | $R_1$ | $R_2$ | $R_3$ | 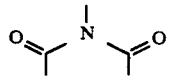 |
|---|---|---|---|---|
| (4) | " | " | " | 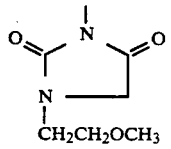 |
| (5) | t-$C_4H_9$ | $CH_3$ | $C_{15}H_{31}$ | 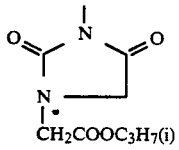 |
| (6) | " | " | " | 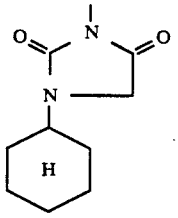 |
| (7) | " | " | $C_{11}H_{23}$ | 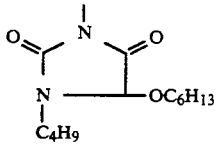 |
| (8) | " | " | " | 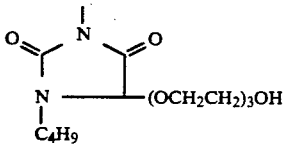 |
| (9) | " | " | $C_9H_{19}$ | 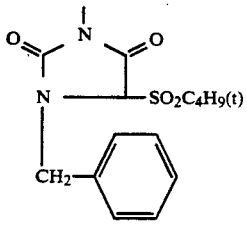 |

-continued
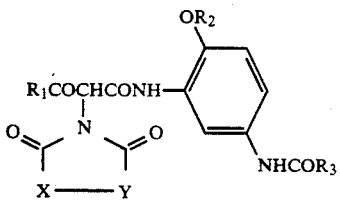
| No. | $R_1$ | $R_2$ | $R_3$ | 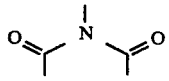 X—Y |
|---|---|---|---|---|
| (10) | t-$C_4H_9$ | $CH_3$ | $C_{13}H_{27}$ | 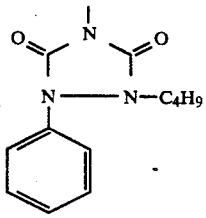 |
| (11) | " | " | " | 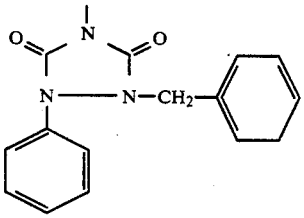 |
| (12) | " | " | " | 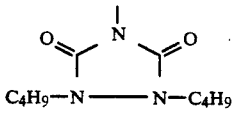 |
| (13) | " | " | $C_{15}H_{31}$ | 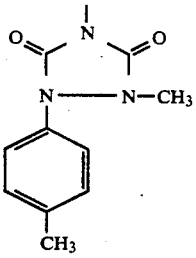 |
| (14) | " | " | " | 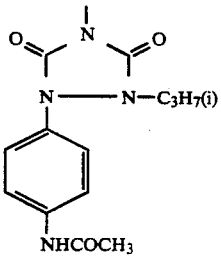 |

-continued
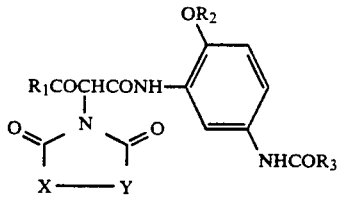
| No. | $R_1$ | $R_2$ | $R_3$ | 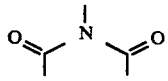 |
|---|---|---|---|---|
| (15) | t-$C_4H_9$ | $CH_3$ | $C_{11}H_{23}$ | 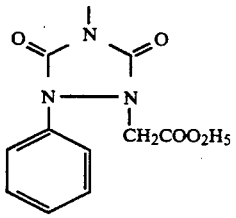 |
| (16) | " | " | " | 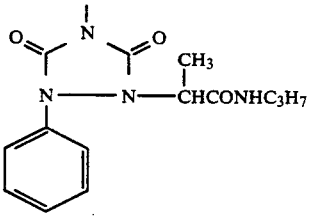 |
| (17) | " | " | $C_9H_{19}$ | 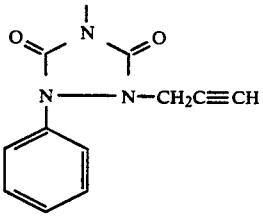 |
| (18) | " | " | $C_{17}H_{35}$ | 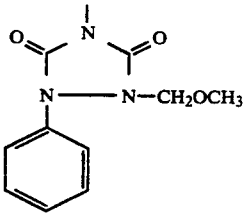 |
| (23) | " | $C_3H_7$(i) | " | 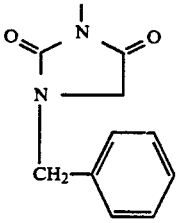 |

-continued
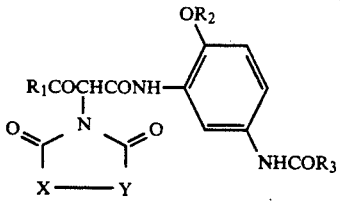
| No. | $R_1$ | $R_2$ | $R_3$ | X—Y |
|---|---|---|---|---|
| (24) | " | 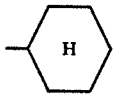 | $C_{13}H_{27}$ | 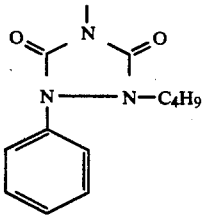 |
| (25) | t-$C_4H_9$ | 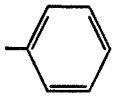 | $C_{13}H_{27}$ | 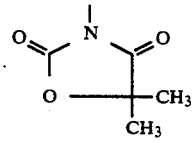 |
| (26) | 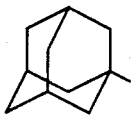 | $CH_3$ | $C_{11}H_{23}$ | 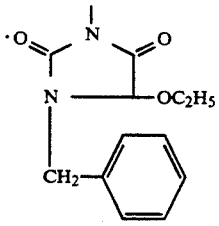 |
* * * * *